US008558131B2

(12) United States Patent
Kiyono et al.

(10) Patent No.: US 8,558,131 B2
(45) Date of Patent: Oct. 15, 2013

(54) SWITCH HAVING A PLUNGER, A SUPPORT TERMINAL, AND A COIL SPRING

(75) Inventors: Yasuhiro Kiyono, Nagaokakyo (JP); Toshihiro Naruo, Kyoto (JP)

(73) Assignee: OMRON Corporation, Kyoto (JP)

( * ) Notice: Subject to any disclaimer, the term of this patent is extended or adjusted under 35 U.S.C. 154(b) by 333 days.

(21) Appl. No.: 12/914,907

(22) Filed: Oct. 28, 2010

(65) Prior Publication Data

US 2011/0209971 A1 Sep. 1, 2011

(30) Foreign Application Priority Data

Feb. 26, 2010 (JP) ..... 2010-042767

(51) Int. Cl.
*H01H 13/30* (2006.01)

(52) U.S. Cl.
USPC ..... 200/520; 200/417

(58) Field of Classification Search
USPC ..... 200/520–524, 529, 530, 545–558, 200/16 A–16 F, 329, 417, 442–468
See application file for complete search history.

(56) References Cited

U.S. PATENT DOCUMENTS

| | | | | |
|---|---|---|---|---|
| 7,009,131 | B2 * | 3/2006 | Diep | 200/523 |
| 8,017,883 | B2 * | 9/2011 | Kiyono et al. | 200/520 |
| 8,134,095 | B2 * | 3/2012 | Kiyono et al. | 200/520 |
| 2009/0008230 | A1 | 1/2009 | Kiyono et al. | |
| 2010/0032273 | A1 | 2/2010 | Kiyono et al. | |

FOREIGN PATENT DOCUMENTS

| | | |
|---|---|---|
| CN | 101645361 A | 2/2010 |
| EP | 2151837 A2 | 2/2010 |
| JP | 2009032646 | 2/2009 |

OTHER PUBLICATIONS

European Search Report for European Application No. 10174184.1-2214, Dated Jun. 15, 2011 (5 Pages).
Examination Report Issued in Chinese Application No. 201010526797.0, Dated May 6, 2013 (15 pages with English Translation).

* cited by examiner

*Primary Examiner* — Amy Cohen Johnson
*Assistant Examiner* — Marina Fishman
(74) *Attorney, Agent, or Firm* — Osha Liang LLP

(57) ABSTRACT

A switch has a base, a housing, a support terminal that is assembled in the base, a moving contact piece that is made of a band-shaped material having a section being formed into a substantial J-shape, a moving contact being provided in one end portion of the moving contact piece, an intermediate portion of the moving contact piece being turnably supported by a turning bracket of the support terminal, a plunger that is accommodated in an internal space while being vertically movable, wherein the internal space is formed by fitting the housing in the base, and a coil spring that is turnably supported by the plunger. The plunger is vertically moved such that one end portion of the coil spring is slid while brought into press-contact with an edge of the other end portion of the moving contact piece, whereby the moving contact piece is inverted to bring and separate the moving contact into contact with and from a fixed contact. The pair of moving contact pieces is disposed on the base such that axis centers of the moving contact pieces are parallel to an axis center in a longitudinal direction of the base and such that the moving contact pieces are located on both sides in a central portion in the longitudinal direction of the base.

17 Claims, 22 Drawing Sheets

SWITCH HAVING A PLUNGER, A SUPPORT TERMINAL, AND A COIL SPRING

BACKGROUND OF THE INVENTION

1. Technical Field

The present invention relates to a switch, particularly to a switch in which a contact can be opened and closed by a pressing manipulation.

2. Related Art

Conventionally, for example, Japanese Unexamined Patent Publication No. 2009-32646 discloses a switch in which a contact can be opened and closed by a pressing manipulation.

In the switch disclosed in Japanese Unexamined Patent Publication No. 2009-32646, a plunger 40 is vertically moved such that one end portion 51 of a coil spring 50 is slid while brought into press-contact with an edge of the other end portion of a moving contact piece 30, whereby the moving contact piece 30 is inverted to bring and separate a moving contact 31 into contact with and from a fixed contact 26.

However, in the switch, a distance between supporting points of the coil springs 50 and 50 is lengthened and horizontal components of force are located in a point-symmetric manner that becomes contraposition as shown in FIG. 22. Therefore, moment around a vertical axis center acts on the plunger 40, and the plunger 40 abuts on one side of an inner peripheral surface of the housing 60, which causes a strange manipulation feeling and a short lifetime of a component.

In the switch, a depth size is increased because a lock pin is disposed in the center of contact mechanisms that are disposed back to back. Therefore, the low-profile switch is not obtained.

Further, in the switch, moment around a horizontal axis center acts on the plunger 40 by spring forces of the coil springs 50 and 50 incorporated in the plunger 40. Therefore, a contact pressure is deviated by a minute inclination generated in the plunger 40, and design work becomes complicated in order to secure a contact balance.

SUMMARY

One or more embodiments of the present invention provide a good-manipulation-feeling, low-profile switch in which the design work is simplified while the component lifetime is lengthened.

In accordance with one aspect of the present invention, a switch includes: a base; a housing; a support terminal that is assembled in the base; a moving contact piece that is made of a band-shaped having a section being formed into a substantial J-shape, a moving contact being provided in one end portion of the moving contact piece, an intermediate portion of the moving contact piece being turnably supported by a turning bracket of the support terminal; a plunger that is accommodated in an internal space while being vertically movable, the internal space is formed by fitting the housing in the base; and a coil spring that is turnably supported by the plunger, wherein the plunger is vertically moved such that one end portion of the coil spring is slid while brought into press-contact with an edge of the other end portion of the moving contact piece, whereby the moving contact piece is inverted to bring and separate the moving contact into contact with and from a fixed contact, and the pair of moving contact pieces is disposed on the base such that axis centers of the moving contact pieces are parallel to an axis center in a longitudinal direction of the base and such that the moving contact pieces are located on both sides in a central portion in the longitudinal direction of the base.

According to one or more embodiments of the present invention, because the large moment around the vertical axis center does not act on the plunger, the plunger does not abut on one side of the inner peripheral surface of the housing, but the good-manipulation-feeling switch in which the component lifetime is lengthened is obtained.

The short-depth-size, low-profile switch is obtained because the moving contact pieces are disposed on both sides in the longitudinal direction of the lock pin.

Because the large moment around the horizontal axis center does not act on the plunger, the plunger is not inclined, and the contact pressure is not deviated. Therefore, the design work that secures the contact balance is eliminated, and the switch in which the design work is simplified is obtained.

According to the present aspect, the switch may further include a lock pin having a lower end portion being turnably supported by the central portion in the longitudinal direction of the base, and an upper end portion of the lock pin abutting turnably on a cam groove in a center of a side face of the plunger, wherein the plunger is vertically moved to slide the upper end portion of the lock pin along the cam groove.

According to the present aspect an alternate type switch is obtained by latching the upper end portion of the lock pin in the cam groove of the plunger.

According to the other aspect, the moving contacts of the pair of moving contact pieces may be disposed outside the turning bracket provided in the pair of support terminals.

According to the present aspect, the switch having high insulating property is obtained because the pair of moving contacts is disposed away from each other.

According to the other aspect, the moving contacts of the pair of moving contact pieces may be disposed inside the turning bracket provided in the pair of support terminals.

In accordance with still another aspect of the present invention, the moving contacts of the pair of moving contact pieces may be disposed on one side in an identical direction of the turning bracket provided in the pair of support terminals.

As a different aspect of the present invention, there is provided a position of an uprise piece in which the turning bracket of the support terminal is provided may be controlled by a position controlling projection provided in an upper-surface edge portion of the base.

According to the present aspect, the position of the uprise piece in which the turning bracket of the support terminal is provided is controlled to improve assembly accuracy, and advantageously the switch having a small variation in operating characteristic is obtained.

DETAILED DESCRIPTION

Figure 1A:
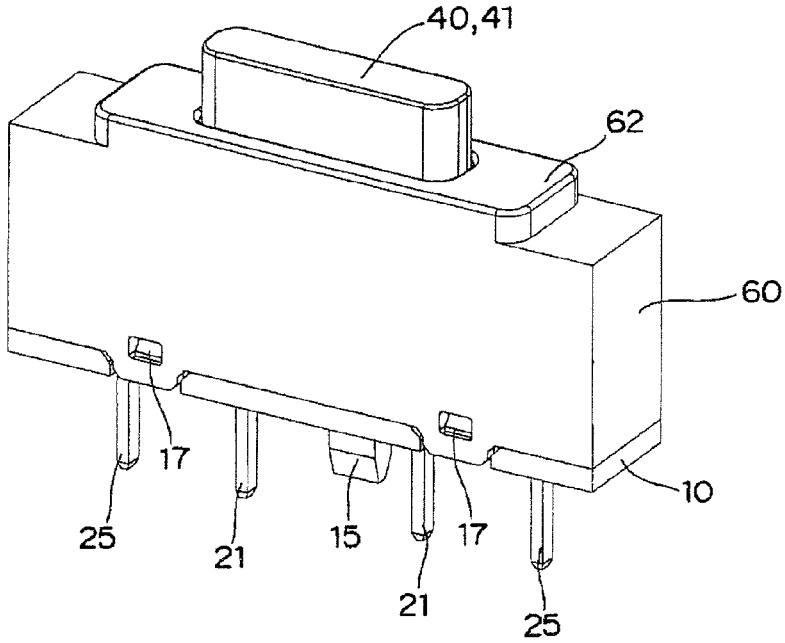
FIGS. 1A and 1B are a perspective view and a partially sectional perspective view showing a switch according to a first embodiment of the invention.

Hereinafter, preferred embodiments of the present invention will be described with reference to the drawings. In embodiments of the invention, numerous specific details are set forth in order to provide a more thorough understanding of the invention. However, it will be apparent to one of ordinary skill in the art that the invention may be practiced without these specific details. In other instances, well-known features have not been described in detail to avoid obscuring the invention.

As illustrated in FIGS. 1 to 11, a switch according to a first embodiment of the invention includes a base 10, two sets of contact mechanisms 20 and 20 assembled in the base 10, a pair of coil springs 50 and 50, a lock pin 35, a plunger 40 configured to manipulate the contact mechanisms 20 and 20, and a housing 60. The housing 60 is fitted in the base 10 to cover the contact mechanisms 20 and 20, and supports the plunger 40 while the plunger 40 is vertically movable.

Figure 2:
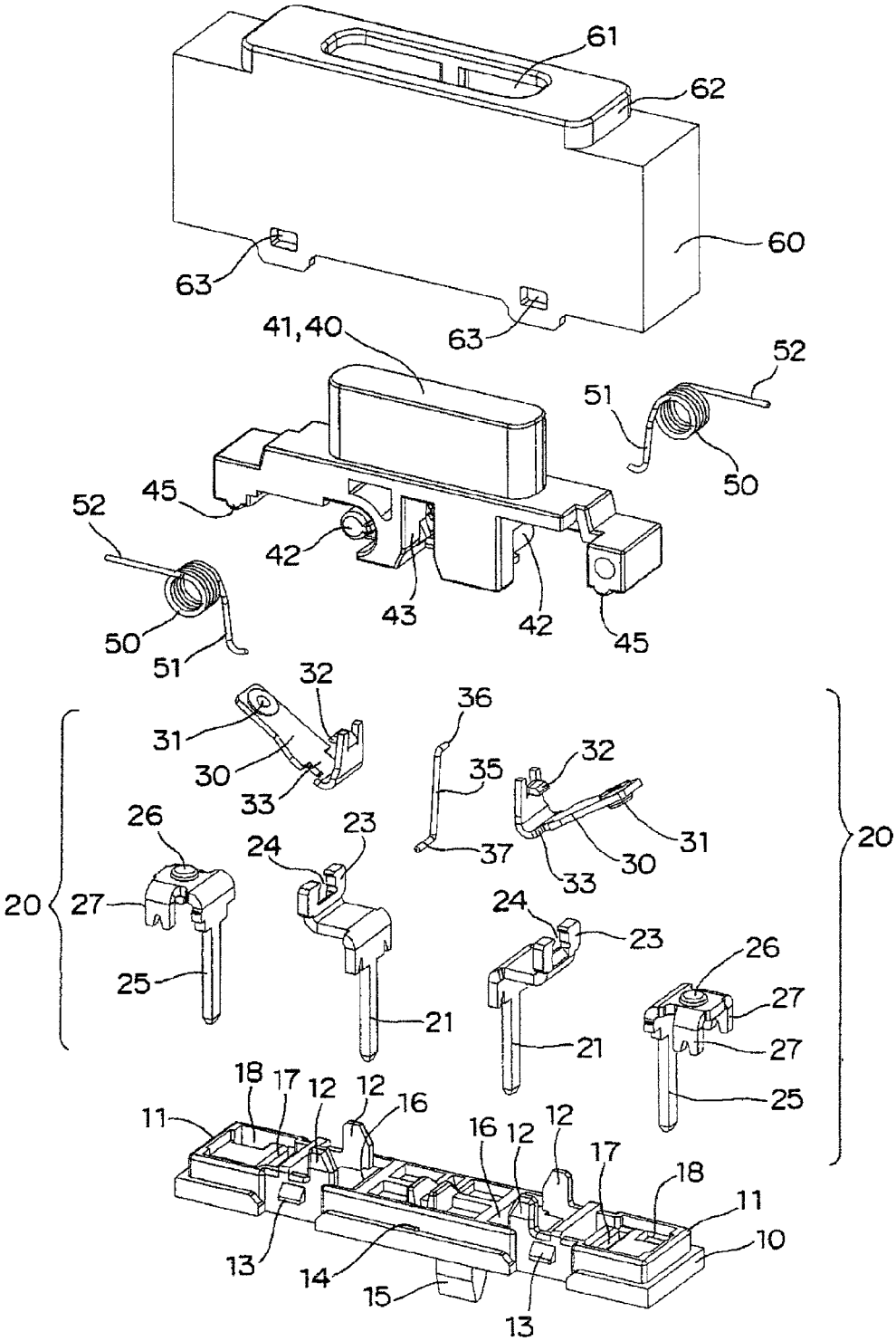
FIG. 2 is an exploded perspective view of the switch of FIG. 1.
Figure 3:
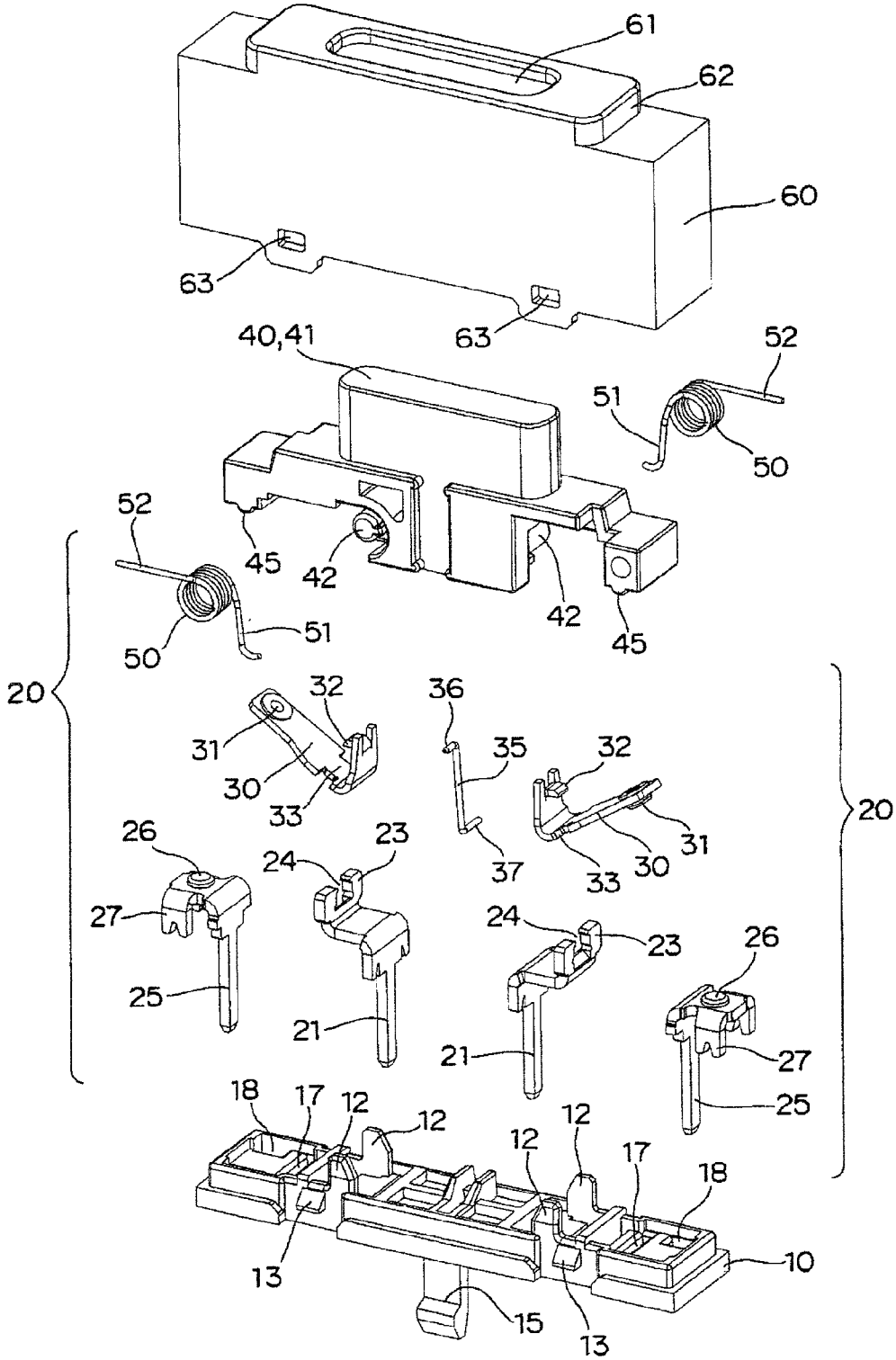
FIG. 3 is an exploded perspective view of the switch of FIG. 1 when viewed from different angle.

As shown in FIG. 2, in the base 10, an annular rib 11 is projected along an upper surface of a peripheral edge portion, and two pairs of position controlling projections 12 are provided in an upper-end edge portion of the annular rib 11. Latching pawls 13 and 13 are projected from a side face of the annular rib 11, and a shaft hole 14 is made between the latching pawls 13 and 13. A latching pawl 15 is projected downward in an edge portion of a bottom surface of the base 10 in order to connect the base to a connector (not shown). In the base 10, press-fitting square holes 16 and 17 are made in the annular rib 11 in order to press fit a support terminal 21 and a fixed contact terminal 25, respectively, and a press-fitting square hole 18 is made in the annular rib 11 in order to press fit a press-fitting tongue piece 27 of the fixed contact terminal 25.

Figure 1B:
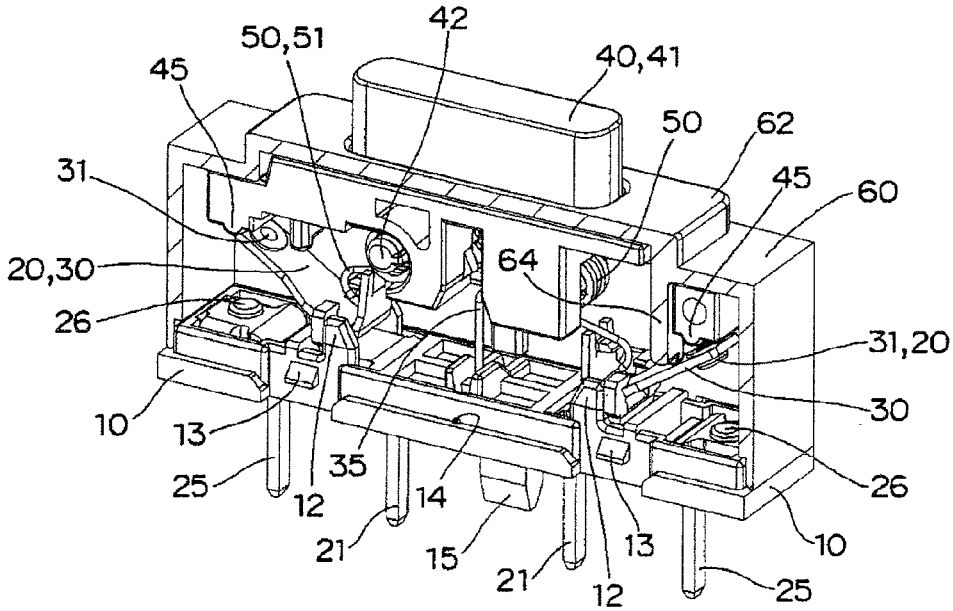

The contact mechanism 20 includes the support terminal 21, the fixed contact terminal 25, and a moving contact piece 30. The support terminal 21 is made of a conductive material having a section being bent into an L-shape, and a turning bracket 24 is formed by noting a leading-end edge portion of an uprise piece 23 extending from an upper end portion of the support terminal 21. The support terminal 21 is assembled by press-fitting a lower end portion of the support terminal 21 in the press-fitting square hole 16 of the base 10. Therefore, positions of edge portions on both sides of the uprise piece 23 are controlled by the position controlling projection 12 (FIG. 1B).

The fixed contact terminal 25 is bent into the substantial L-shape, a fixed contact 26 is provided in one end portion thereof, and the press-fitting tongue pieces 27 extend from edge portions on both sides in one end portion. The fixed contact terminal 25 is assembled by press-fitting the lower end portion and the press-fitting tongue piece 27 of the fixed contact terminal 25 in the square holes 17 and 18 of the base 10.

The moving contact piece 30 is made of a band-shaped conductive material having a section being bent into a substantial J-shape, a moving contact 31 is provided in one end portion, and a sliding tongue piece 32 is cut out in a leading end surface of the other end portion. A narrow portion 33 formed by notching the edge portions on both sides is engaged with the turning bracket 24 of the support terminal 21, thereby turnably supporting the moving contact piece 30 (FIG. 1B).

Upper and lower end portions 36 and 37 of a lock pin 35 are formed by bending both end portions of a rod-shape metallic material in opposite directions.

Figure 4A:
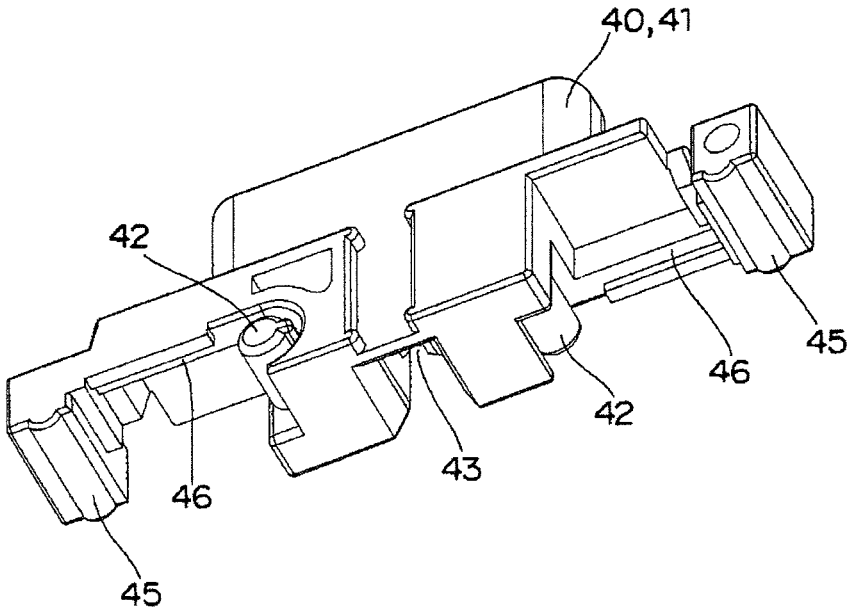
FIGS. 4A and 4B are perspective views of a plunger of FIG. 2.
Figure 4B:
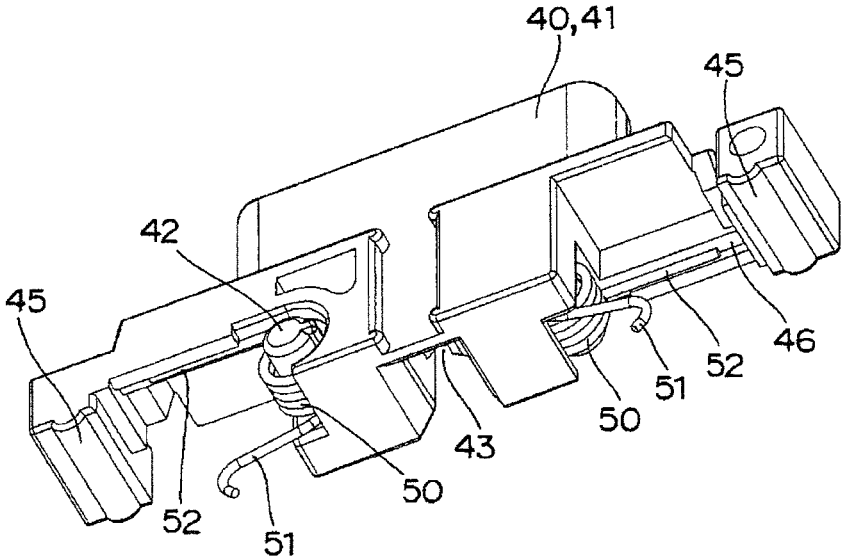
Figure 5B:
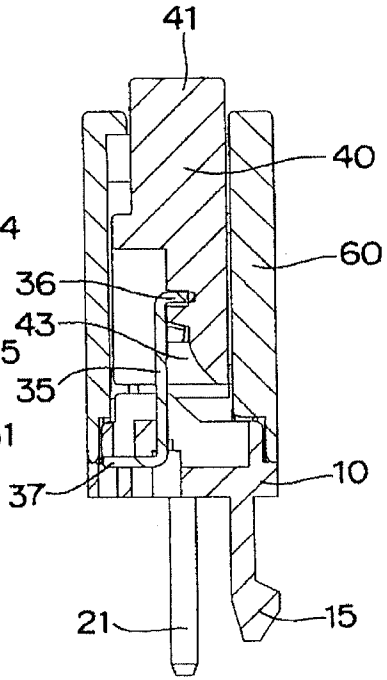
FIGS. 5A and 5B are a front-face sectional view and a side-face sectional view of the switch of FIG. 1.
Figure 5A:
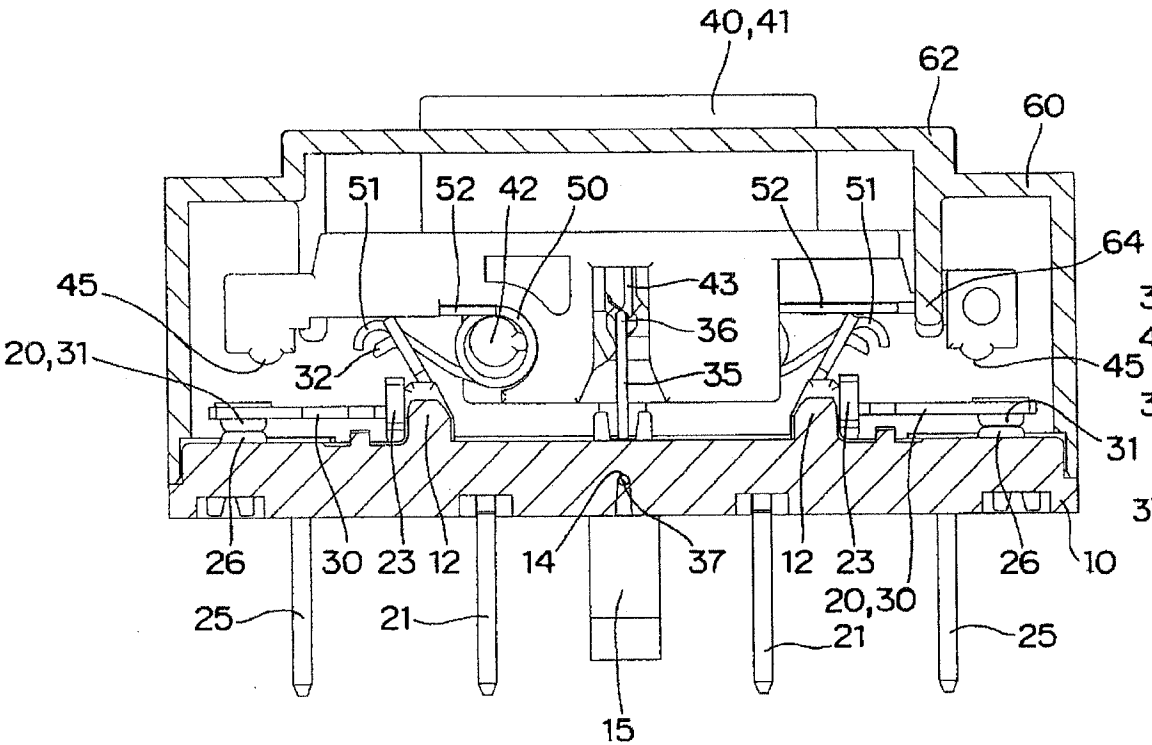

As shown in FIG. 2, the plunger 40 has a planar shape that overlaps an upper surface of the base 10, and a manipulation portion 41 is projected from a central portion in the upper surface of the base 10. As shown in FIG. 4, shaft portions 42 are formed in a point-symmetric manner in a front face and a rear face of the plunger 40, respectively. The shaft portions 42 support coil springs 50 and 50 while the coil springs 50 and 50 are laterally inserted in the shaft portions 42. In the plunger 40, a cam groove 43 is formed in the center of the outer side face. The cam groove 43 is configured to lock the plunger 40 at a predetermined position with the lock pin 35 interposed therebetween. A pressing projection 45 is provided in parallel with the shaft portion 42 in the lower surface of the plunger 40. The coil spring 50 is inserted in the shaft portion 42, and one end portion of the coil spring 50 is engaged in a position controlling step 46 formed in a ceiling surface of the plunger 40, thereby preventing spin-around of the coil spring 50.

As shown in FIG. 2, the housing 60 has a box shape so as to be able to be fitted in the outer peripheral portion of the base 10 in which the contact mechanisms 20 and 20 and the plunger 40 are assembled. An annular step 62 is provided in an opening edge portion of a manipulation hole 61 made in the center of the upper surface of the housing 60. In the housing 60, engagement holes 63 are made opposite each other in the lower opening edge portion, and stoppers 64 (FIG. 6) are provided in the inner side faces that are opposite to the engagement holes 63.

In assembling the switch of the first embodiment, the support terminal 21, the fixed contact terminal 25, and the press-fitting tongue piece 27 are press-fitted in the square holes 16, 17, and 18 of the base 10. Therefore, the edge portions on both sides of the uprise piece 23 of the support terminal 21 abut on the position controlling projection 12 of the base 10, thereby controlling the position of the support terminal 21. Then the lower end portion 37 of the lock pin 35 is inserted in the shaft hole 14 of the base 10 while the narrow portion 33 of the moving contact piece 30 is engaged in the turning bracket 24 of the support terminal 21. The moving contact pieces 30 and 30 and the lock pin 35 are erected with a jig (not shown).

On the other hand, the manipulation portion 41 of the plunger 40 in which the coil springs 50 are inserted in the shaft portions 42 is assembled by inserting the manipulation portion 41 in the manipulation hole 61 of the housing 60. Then, the housing 60 is assembled from above in the base 10, and the upper end portion 36 of the lock pin 35 is engaged in the cam groove 43 of the plunger 40 while one end portion 51 of the coil spring 50 is caused to abut on the sliding tongue piece 32 of the moving contact piece 30. The assembly work is completed by engaging the latching pawls 13 of the base 10 in the engagement holes 63 of the housing 60.

A method for manipulating the switch of the first embodiment will be described below.

Figure 6A:
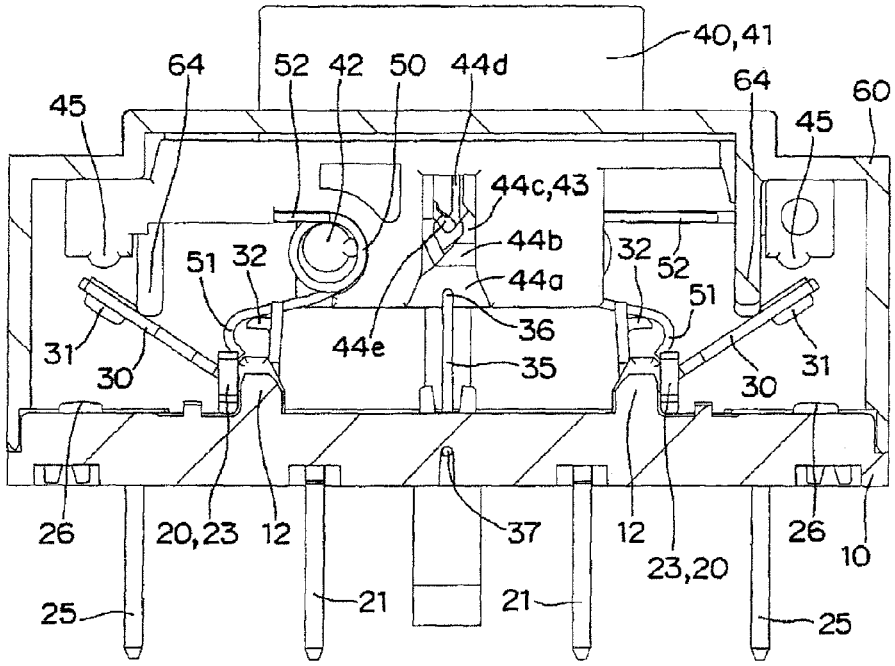
FIGS. 6A and 6B are enlarged sectional views showing a manipulation process.

As shown in FIG. 6A, the plunger 40 is biased upward by a spring force of the coil spring 50 before the manipulation. On the other hand, one end portion 51 of the coil spring 50 presses down the sliding tongue piece 32 of the moving contact piece 30. Therefore, one end portion of the moving contact piece 30 abuts on the lower end portion of the stopper 64 projected from the inner side face of the housing 60, and the position of the moving contact piece 30 is controlled, whereby the moving contact piece 30 does not drop off. At this point, the upper end portion 36 of the lock pin 35 is located in an initial region 44*a* of the cam groove 43 of the plunger 40.

Figure 6B:
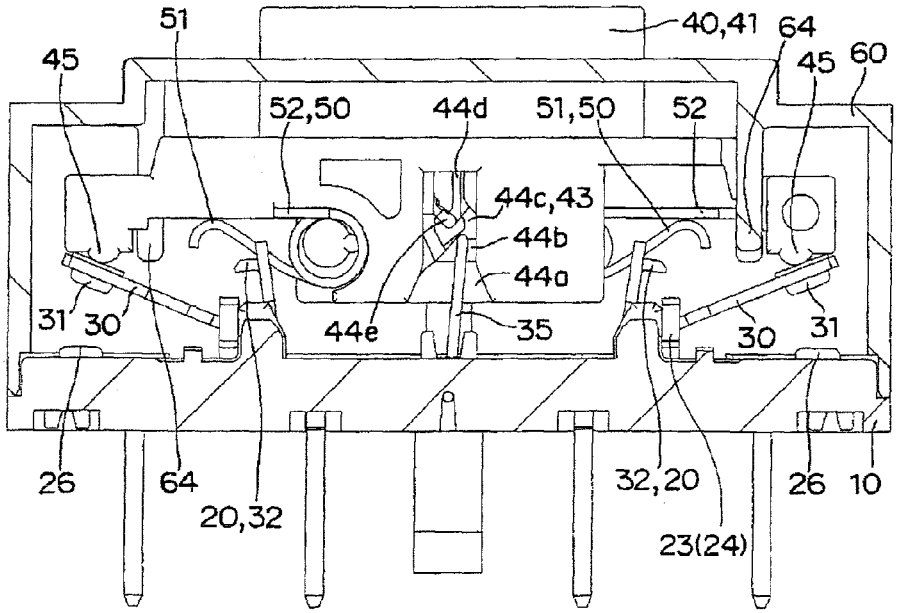
Figure 7A:
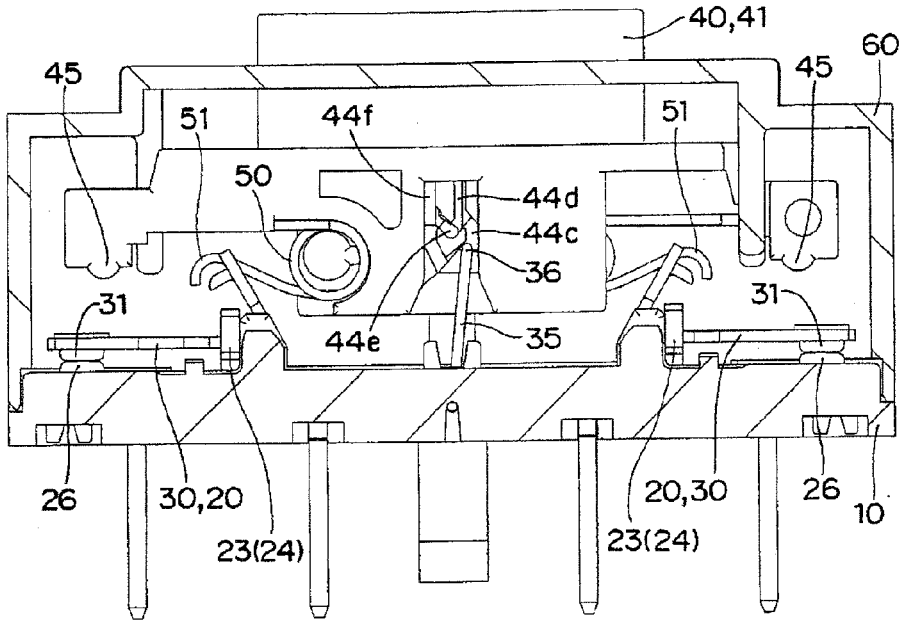
FIGS. 7A and 7B are enlarged sectional views showing the manipulation process continuous from FIG. 6.

When the manipulation portion 41 of the plunger 40 is pressed down, the coil spring 50 is bent, and one end portion 51 of the coil spring 50 biases the moving contact piece 30 in a direction in which the moving contact piece 30 is raised while slid on the sliding tongue piece 32 of the moving contact piece 30. The pressing projection 45 presses down one end portion of the moving contact piece 30. At this point, the upper end portion 36 of the lock pin 35 is moved in first and second inclined grooves 44*b* and 44*c* from the initial region 44*a* of the cam groove 43 (FIG. 6B). When one end portion 51 of the coil spring 50 exceeds a predetermined position by pushing the manipulation portion 41 of the plunger 40, one end portion 51 of the coil spring 50 biases the moving contact piece 30 in a direction in which the moving contact piece 30 is pushed down. Therefore, the moving contact piece 30 turns instantaneously while the turning bracket 24 is used as a supporting point, and the moving contact 31 comes into contact with the fixed contact 26 (FIG. 7A).

Figure 7B:
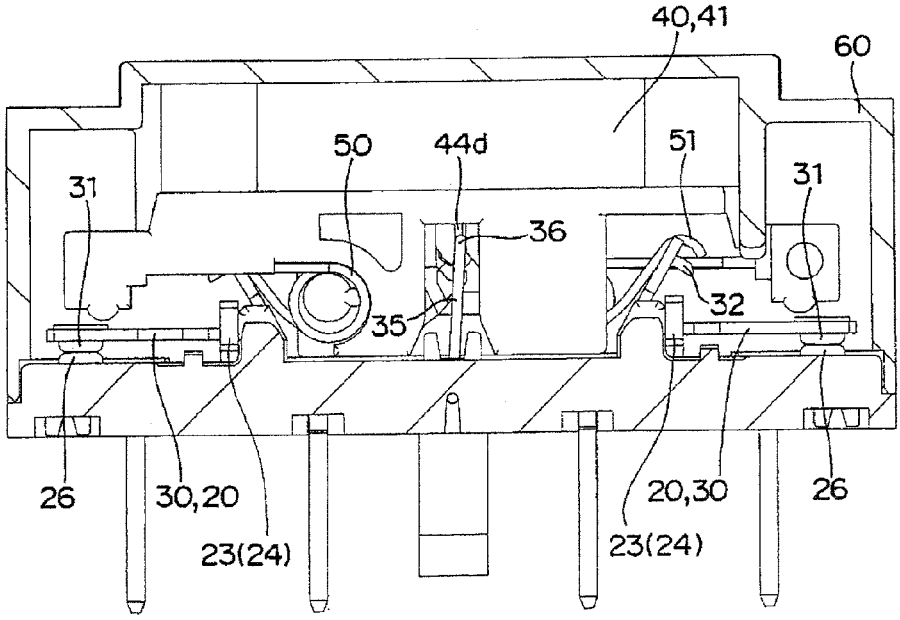
Figure 8:
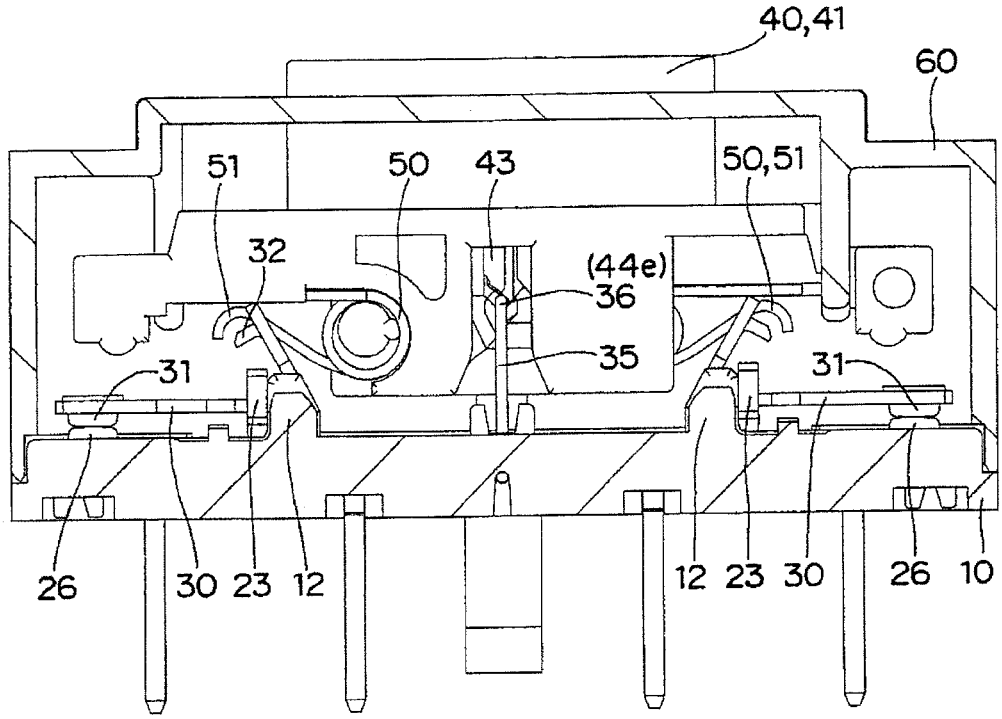
FIG. 8 is an enlarged sectional view showing the manipulation process continuous from FIG. 7.

Then the upper end portion 36 of the lock pin 35 reaches a third inclined groove 44*d* by pushing the manipulation portion 41 of the plunger 40 to a lowermost level (FIG. 7B). When the pressing force of the plunger 40 is released, the plunger 40 is pushed up by the spring force of the coil spring 50, and the upper end portion 36 of the lock pin 35 is latched at a locked position 44*e* (FIG. 8) to control the return of the plunger 40 to the upward direction, whereby the plunger 40 is in a locked state. Therefore, one end portion 51 of the coil spring 50 continuously biases the moving contact piece 30 so as to push down the moving contact piece 30, and the moving contact 31 is continuously in contact with the fixed contact 26.

Figure 9A:
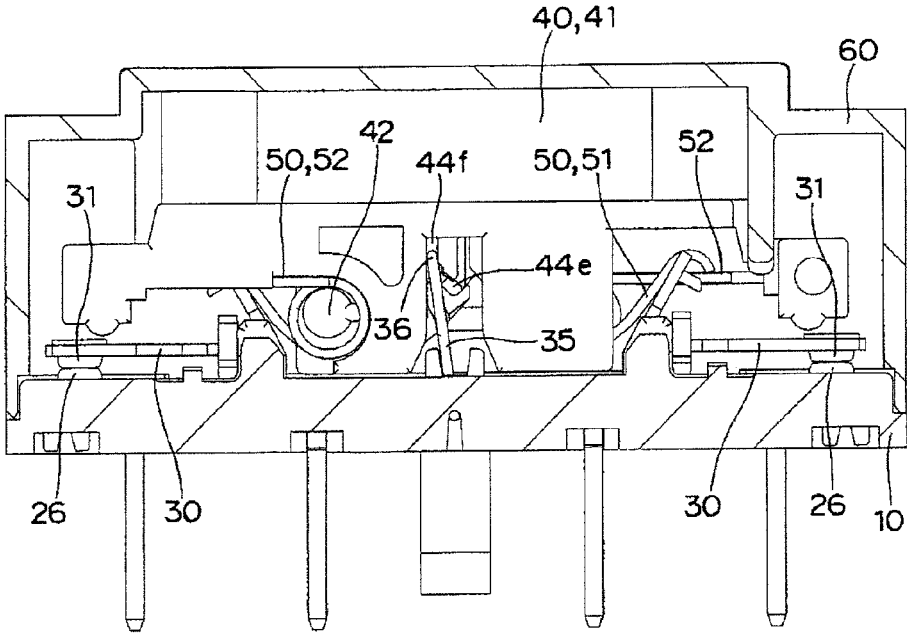
FIGS. 9A and 9B are enlarged sectional views showing the manipulation process continuous from FIG. 8.
Figure 9B:
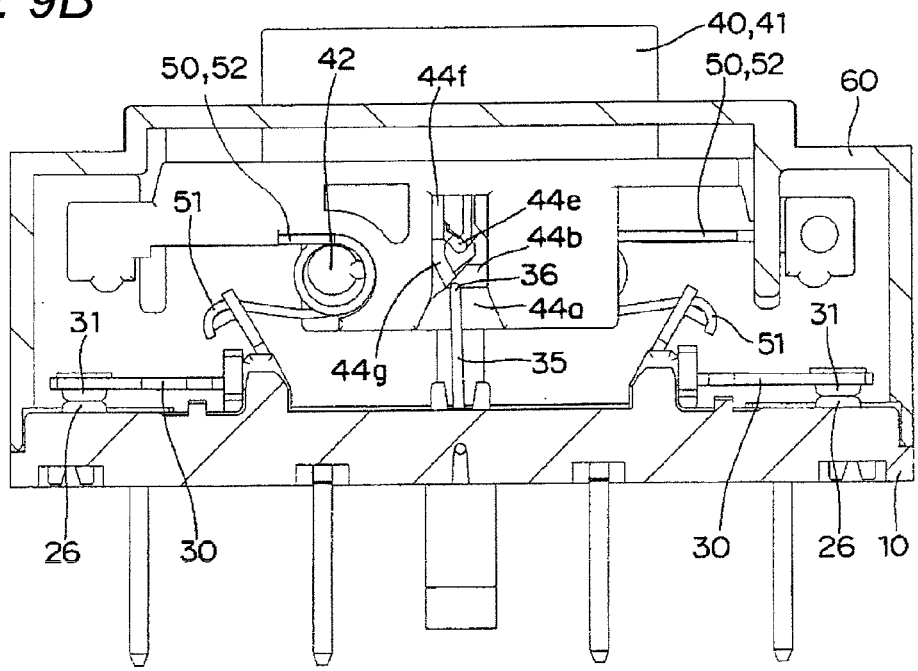
Figure 10A:
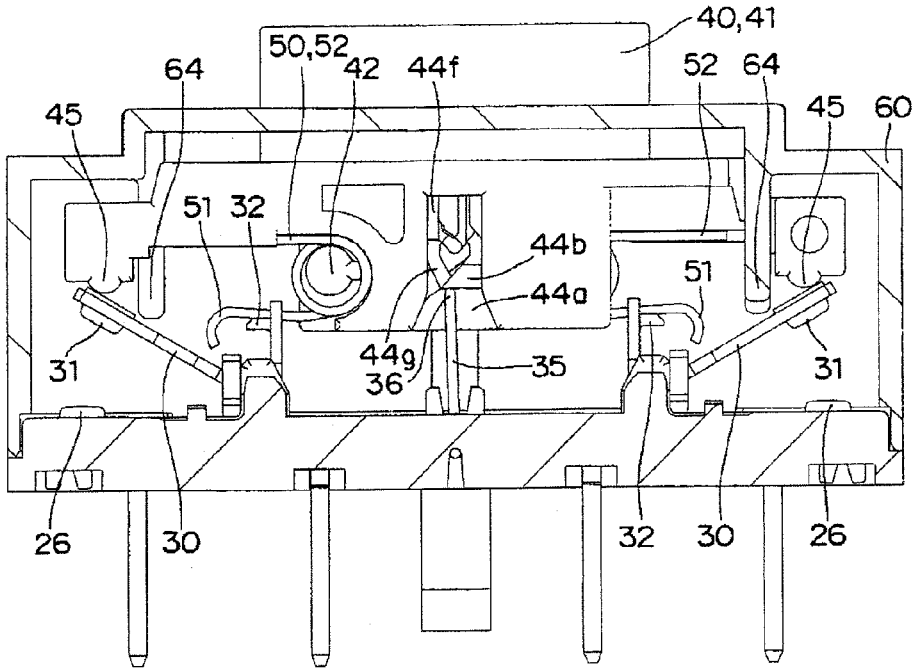
FIGS. 10A and 10B are enlarged sectional views showing the manipulation process continuous from FIG. 9.
Figure 10B:
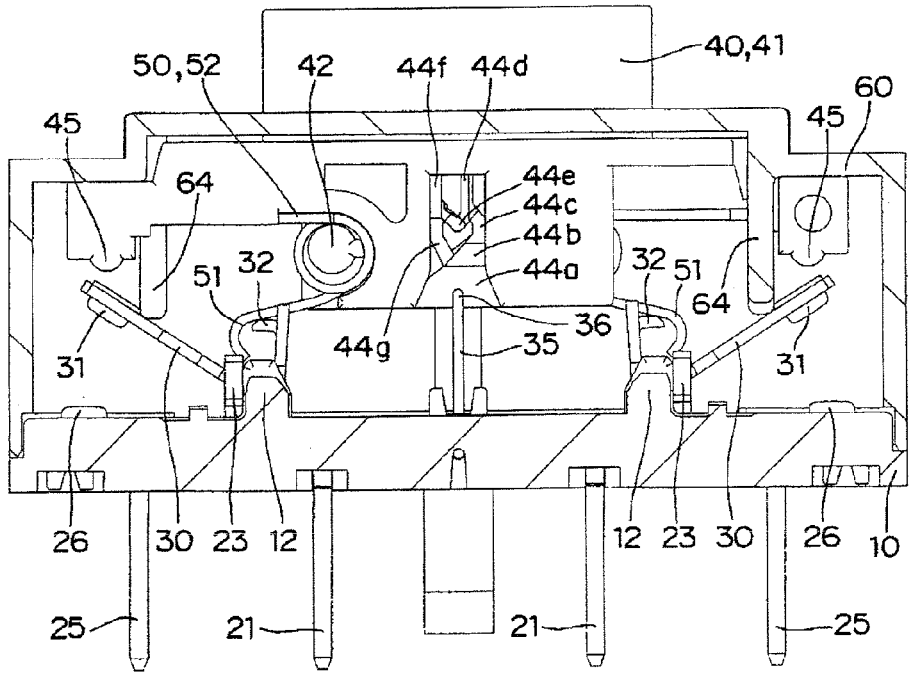

In releasing the locked state (FIG. 8), the manipulation portion 41 of the plunger 40 is pressed down deeper (FIG. 9A), and the upper end portion 36 of the lock pin 35 is moved from the locked position 44*e* to a fourth inclined groove 44*f*, thereby releasing the locked state. When the pressing force applied to the manipulation portion 41 is released, the coil spring 50 pushes up the plunger 40 while biasing the moving contact piece 30 in the direction in which the moving contact piece 30 is pushed down (FIG. 9B). Therefore, the upper end portion 36 of the lock pin 35 passes through a fifth inclined groove 44*g* to return to the first inclined groove 44*b*. When the plunger 40 returns automatically to the original position, one end portion 51 of the coil spring 50 biases the moving contact piece 30 in the direction in which the moving contact piece 30 is raised from the predetermined position, and the moving contact piece 30 turns instantaneously while the turning bracket 24 is used as the supporting point, thereby separating the moving contact 31 from the fixed contact 26 (FIG. 10A). After the moving contact piece 30 further turns, one end portion of the moving contact piece 30 abuts on the pressing projection 45 of the plunger 40. Then one end portion of the moving contact piece 30 abuts on the stopper 64 provided in the inner side face of the housing 60, and the position of the moving contact piece 30 is controlled. The upper end portion 36 of the lock pin 35 returns to the initial region 44*a* (FIG. 10B).

Figure 11A:
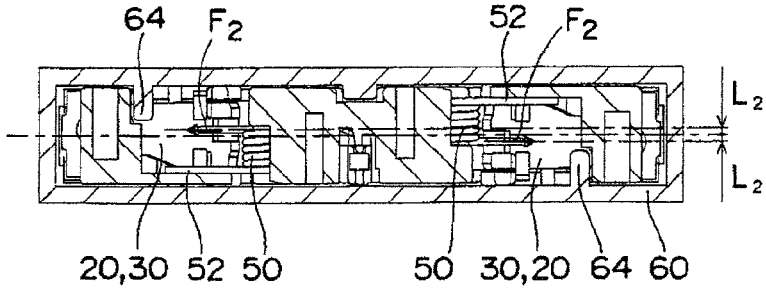
FIGS. 11A, 11B, and 11C are sectional view for explaining action of torsion moment.
Figure 11B:
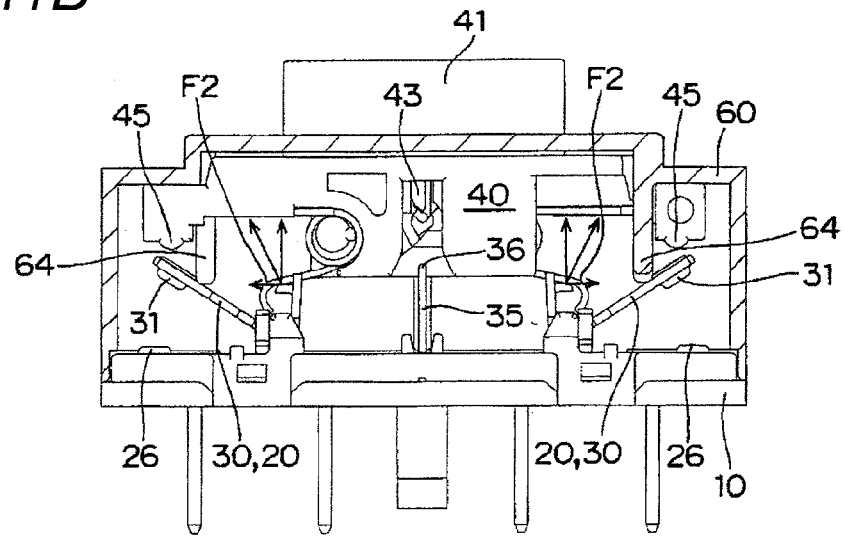
Figure 11C:
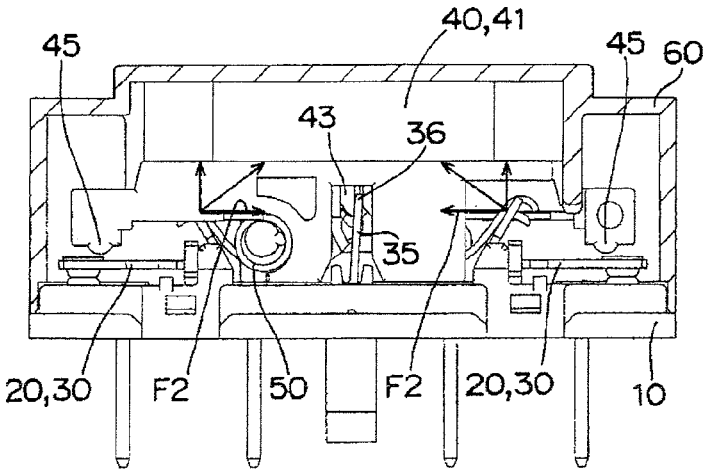
Figure 12A:
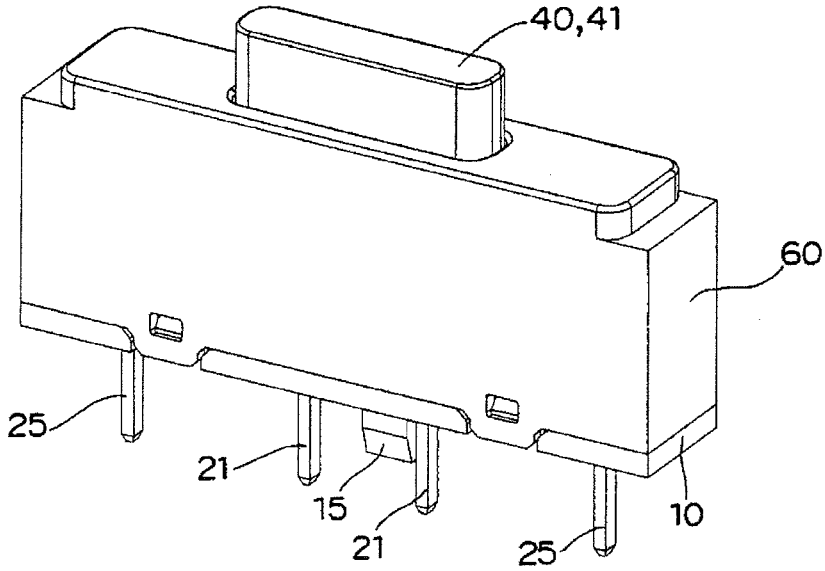
FIGS. 12A and 12B are a perspective view and a partially sectional perspective view showing a switch according to a second embodiment of the invention.
Figure 12B:
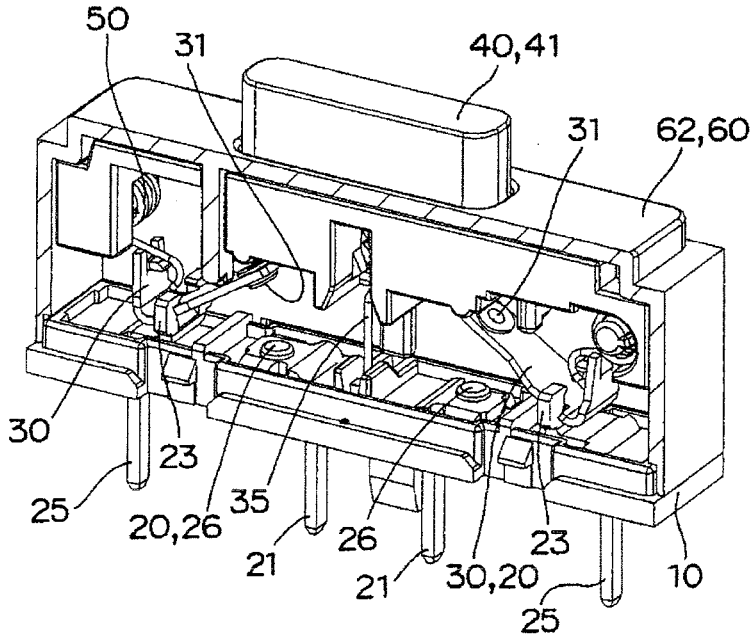
Figure 13:
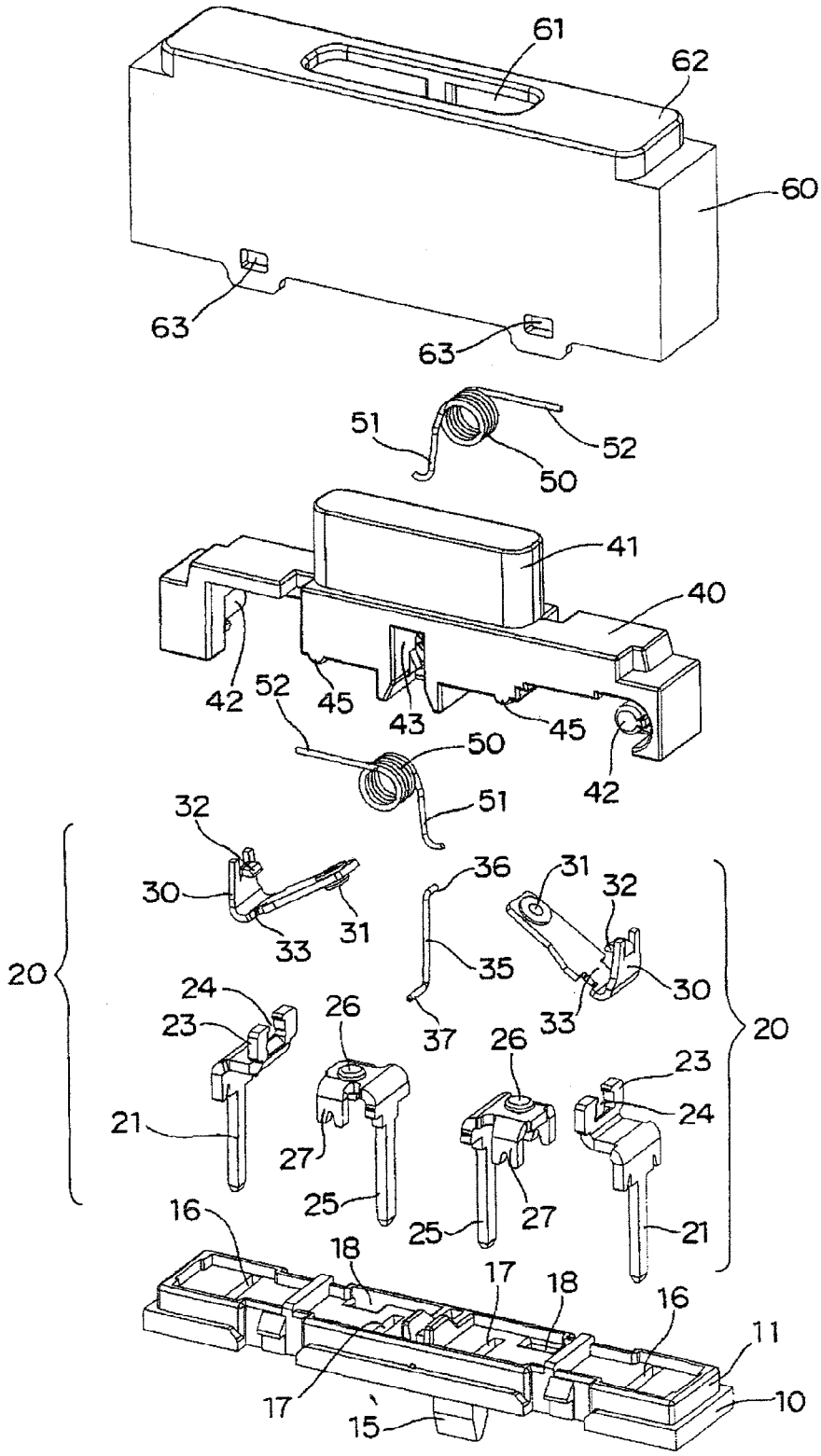
FIG. 13 is an exploded perspective view of the switch of FIG. 12.
Figure 14:
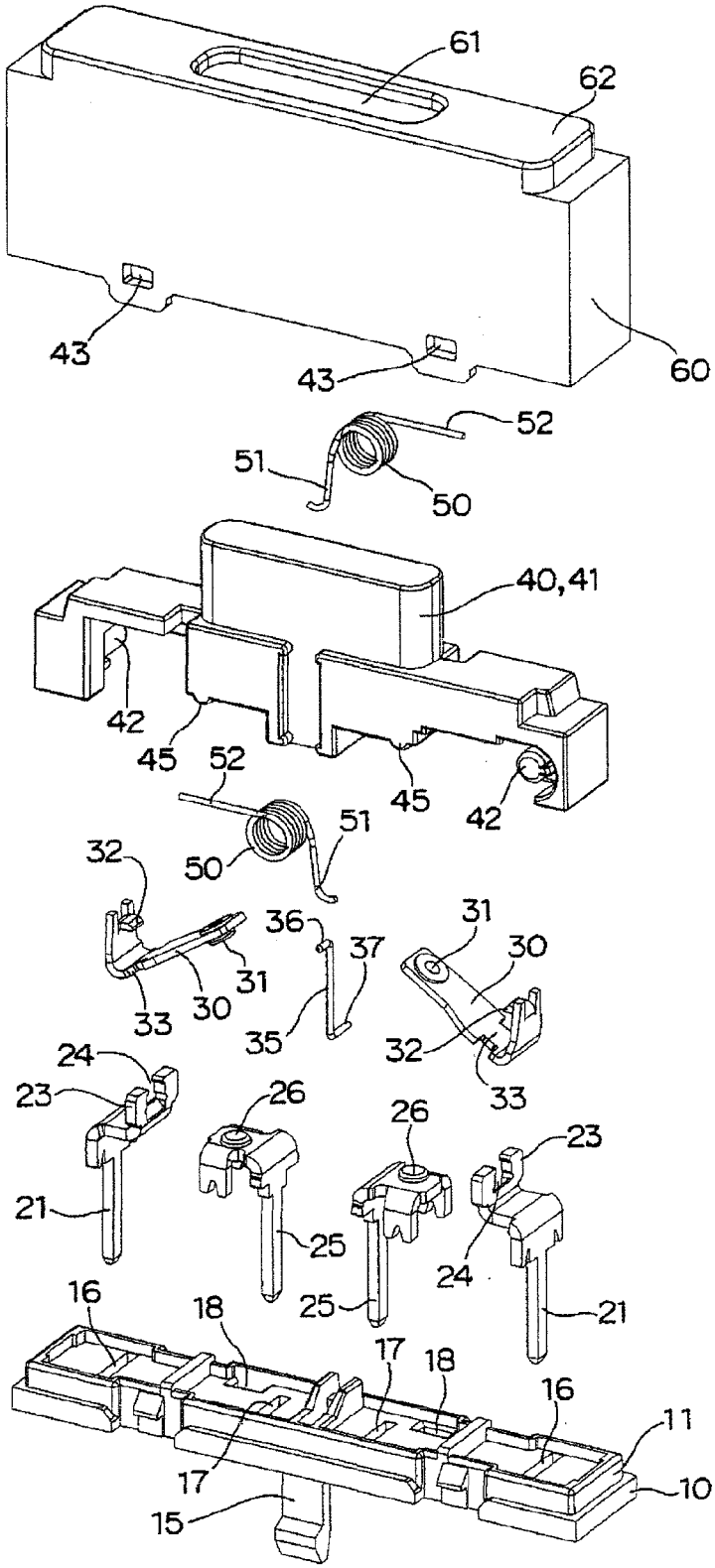
FIG. 14 is an exploded perspective view of the switch of FIG. 12 when viewed from a different angle.
Figure 15A:
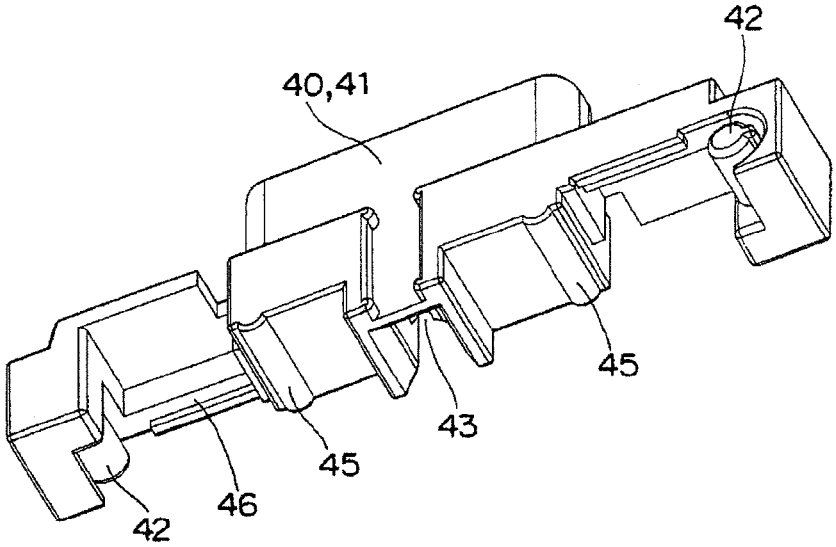
FIGS. 15A and 15B are perspective views of a plunger of FIG. 13.
Figure 15B:
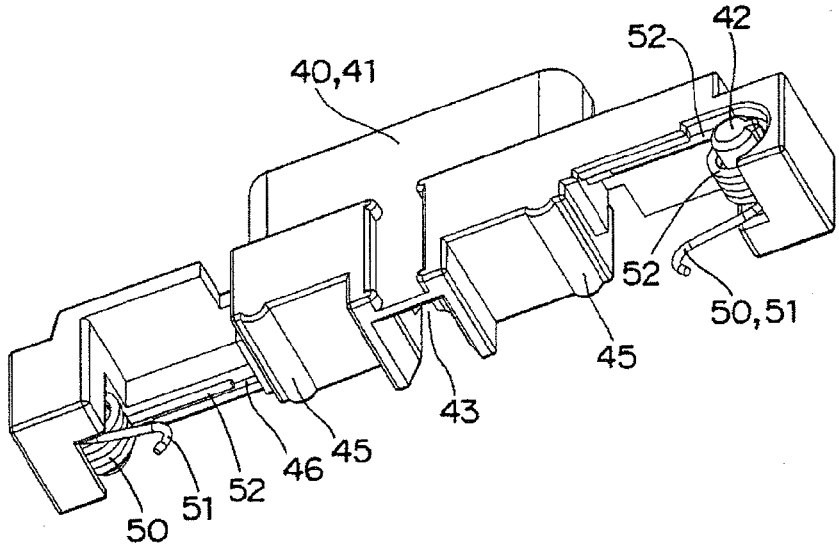
Figure 22A:
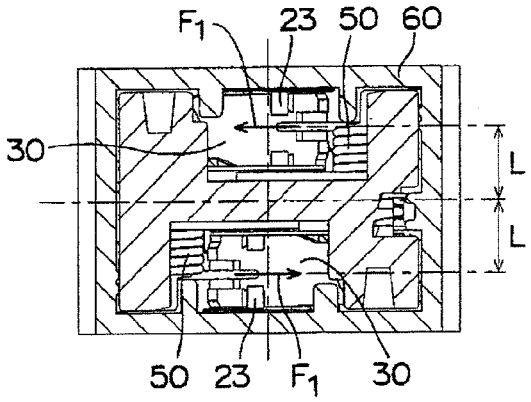
FIGS. 22A, 22B, and 22C are a transverse sectional view and longitudinal sectional views showing a conventional switch.
Figure 22B:
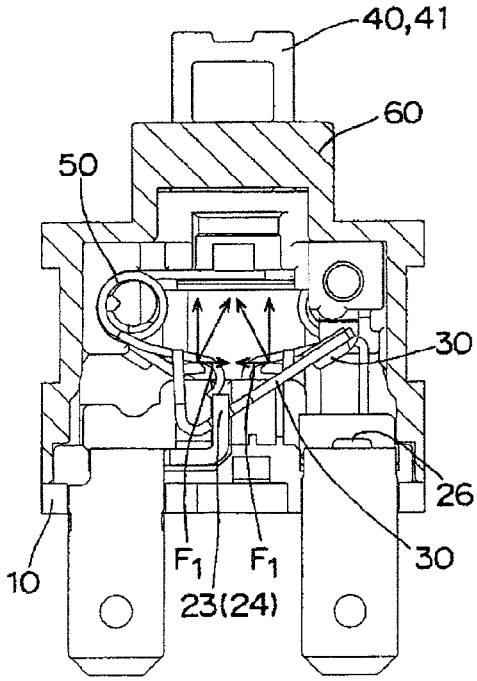
Figure 22C:
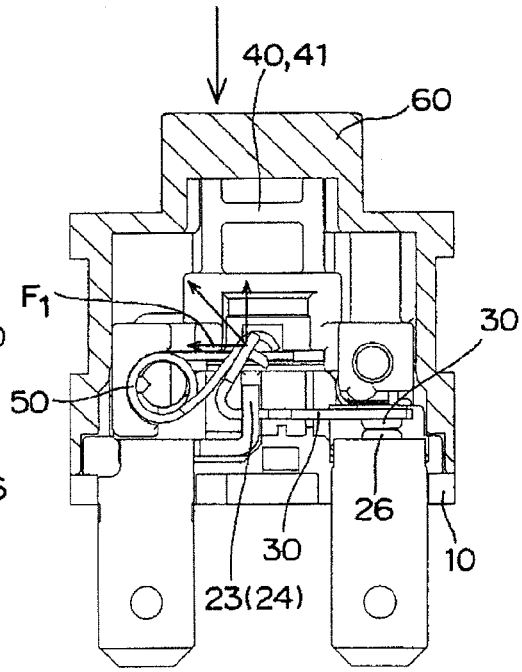

According to the first embodiment, as shown in FIG. 11A, even if a horizontal component of force $F_2$ (FIGS. 11B and 11C) of the coil spring 50 is equal to a horizontal component of force $F_1$ (FIG. 22) of the conventional example of FIG. 22, a distance between supporting points $L_2$ (FIG. 11A) of the coil spring 50 of the first embodiment is shorter than a distance between supporting points $L_1$ (FIG. 22) of the conventional example. Therefore, because of the small torsion moment applied to the plunger 40 around the vertical axis center, the plunger 40 does not abut on one side of the inner side face of the housing 60, but the switch having the good manipulation feeling is advantageously obtained.

As shown in FIGS. 12 to 15, a switch according to a second embodiment of the invention is substantially similar to that of the first embodiment except that the moving contacts 31 and 31 of the moving contact pieces 30 and 30 are disposed inside the turning bracket 24 that becomes the supporting point of the turn. Because other configurations of the second embodiment are similar to those of the first embodiment, the same component is designated by the same numeral, and the description is not given.

Similarly to the first embodiment, the position controlling projection 12 may be provided in the upper-end edge portion of the annular rib 11 projected from the base 10 such that the position of the uprise piece 23 of the support terminal 21 is controlled.

As shown in FIGS. 16 to 20, a method for manipulating the switch of the second embodiment will be described below.

Figure 16A:
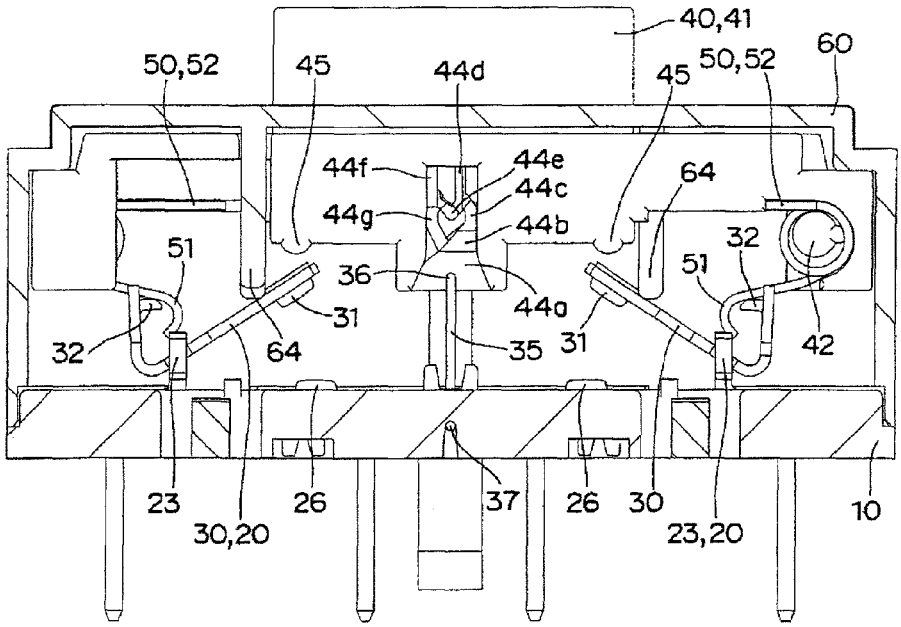
FIGS. 16A and 16B are enlarged sectional views showing a manipulation process.

As shown in FIG. 16A, the plunger 40 is biased upward by the spring force of the coil spring 50 before the manipulation. On the other hand, one end portion 51 of the coil spring 50 presses down the sliding tongue piece 32 of the moving contact piece 30. Therefore, one end portion of the moving contact piece 30 abuts on the lower end portion of the stopper 64 projected from the inner side face of the housing 60, and the position of the moving contact piece 30 is controlled, whereby the moving contact piece 30 does not drop off. At this point, the upper end portion 36 of the lock pin 35 is located in the initial region 44*a* of the cam groove 43 of the plunger 40.

Figure 16B:
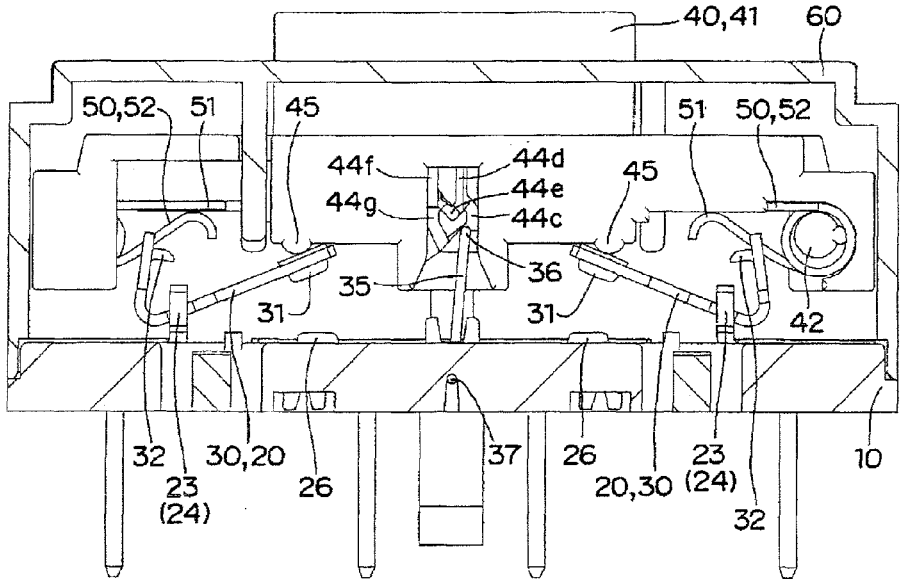
Figure 17A:
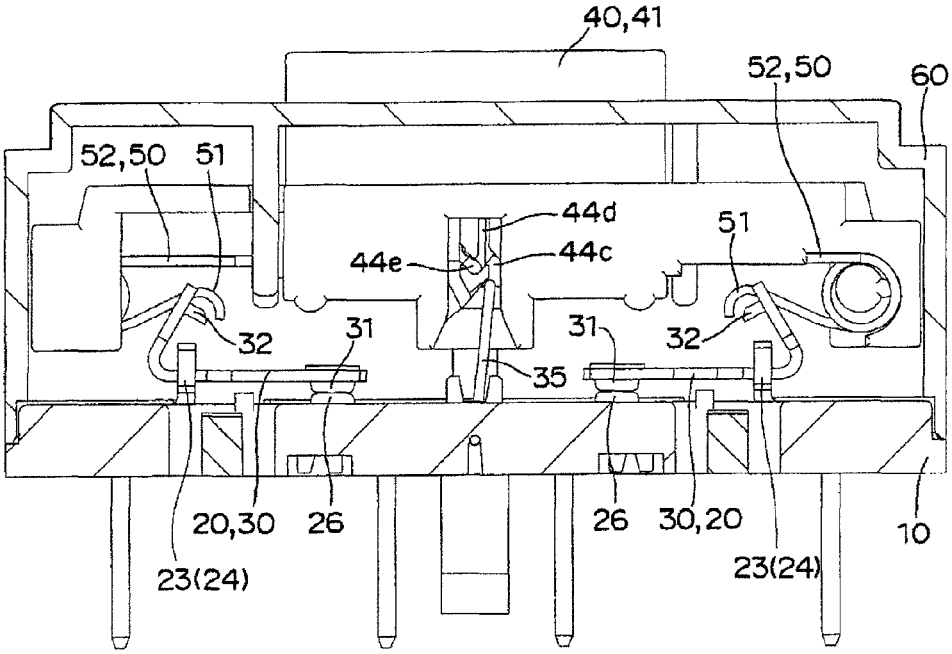
FIGS. 17A and 17B are enlarged sectional views showing the manipulation process continuous from FIG. 16.

When the manipulation portion 41 of the plunger 40 is pressed down, the coil spring 50 is bent, and one end portion 51 of the coil spring 50 biases the moving contact piece 30 in a direction in which the moving contact piece 30 is raised while slid on the sliding tongue piece 32 of the moving contact piece 30. The pressing projection 45 presses down one end portion of the moving contact piece 30. At this point, the upper end portion 36 of the lock pin 35 is moved in first and second inclined grooves 44*b* and 44*c* from the initial region 44*a* of the cam groove 43 (FIG. 16B). When one end portion 51 of the coil spring 50 exceeds a predetermined position by pushing the manipulation portion 41 of the plunger 40, one end portion 51 of the coil spring 50 biases the moving contact piece 30 in a direction in which the moving contact piece 30 is pushed down. Therefore, the moving contact piece 30 turns instantaneously while the turning bracket 24 is used as a supporting point, and the moving contact 31 comes into contact with the fixed contact 26 (FIG. 17A).

Figure 17B:
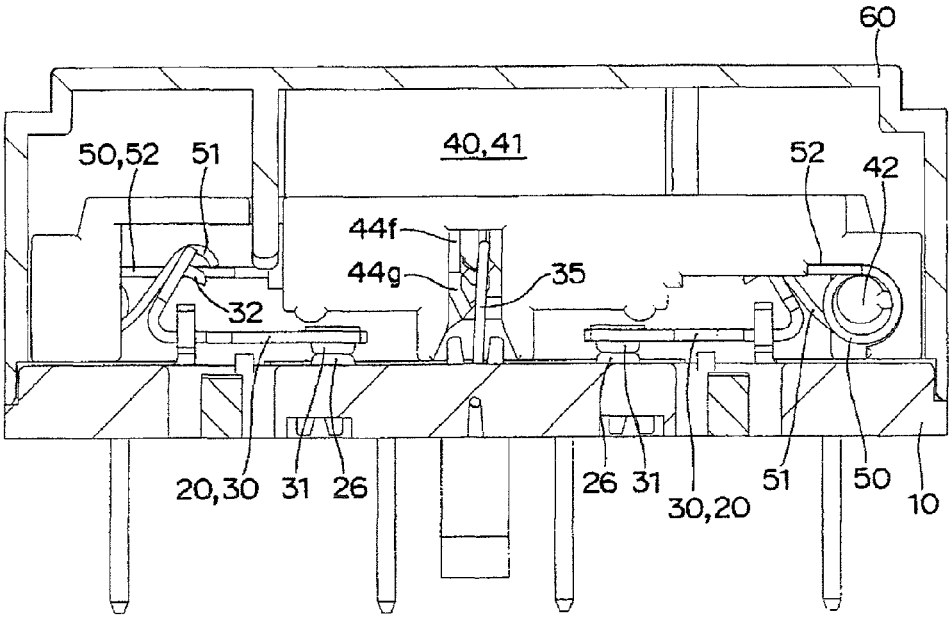
Figure 18:
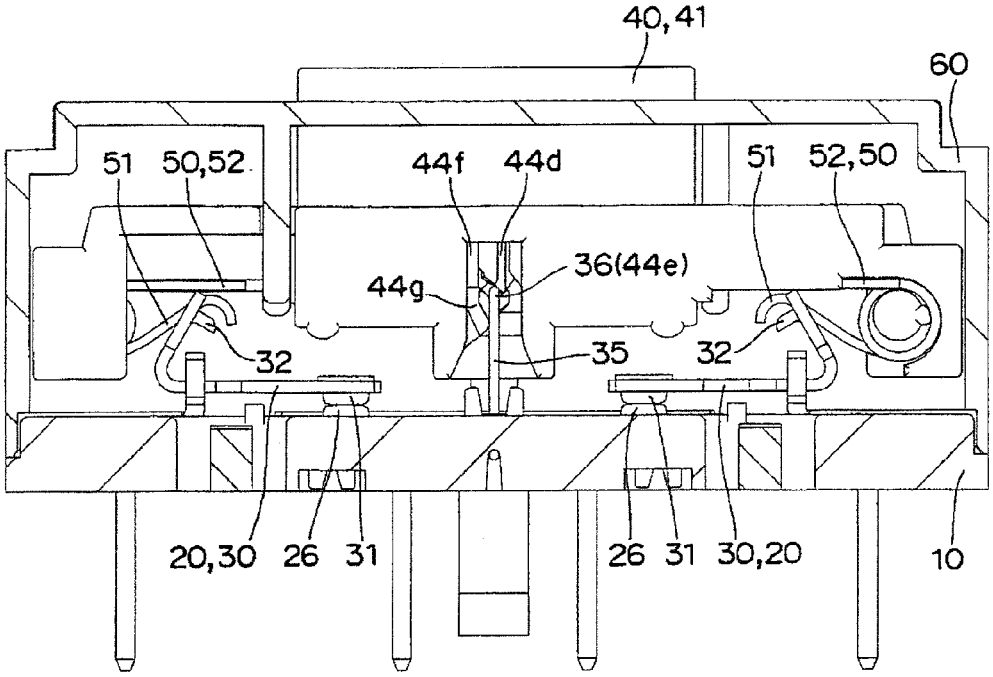
FIG. 18 is an enlarged sectional view showing the manipulation process continuous from FIG. 17.

Then the upper end portion 36 of the lock pin 35 reaches a third inclined groove 44*d* by pushing the manipulation portion 41 of the plunger 40 to a lowermost level (FIG. 17B). When the pressing force of the plunger 40 is released, the plunger 40 is pushed up by the spring force of the coil spring 50, and the upper end portion 36 of the lock pin 35 is latched at a locked position 44*e* (FIG. 18) to control the return of the plunger 40 to the upward direction, whereby the plunger 40 is in the locked state. Therefore, one end portion 51 of the coil spring 50 continuously biases the moving contact piece 30 so as to push down the moving contact piece 30, and the moving contact 31 is continuously in contact with the fixed contact 26.

Figure 19A:
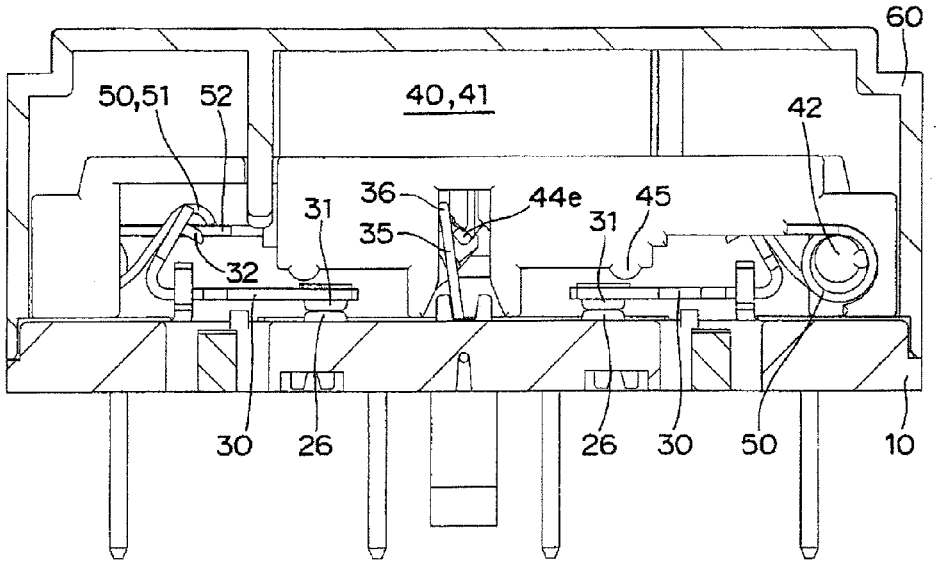
FIGS. 19A and 19B are enlarged sectional views showing the manipulation process continuous from FIG. 18.
Figure 19B:
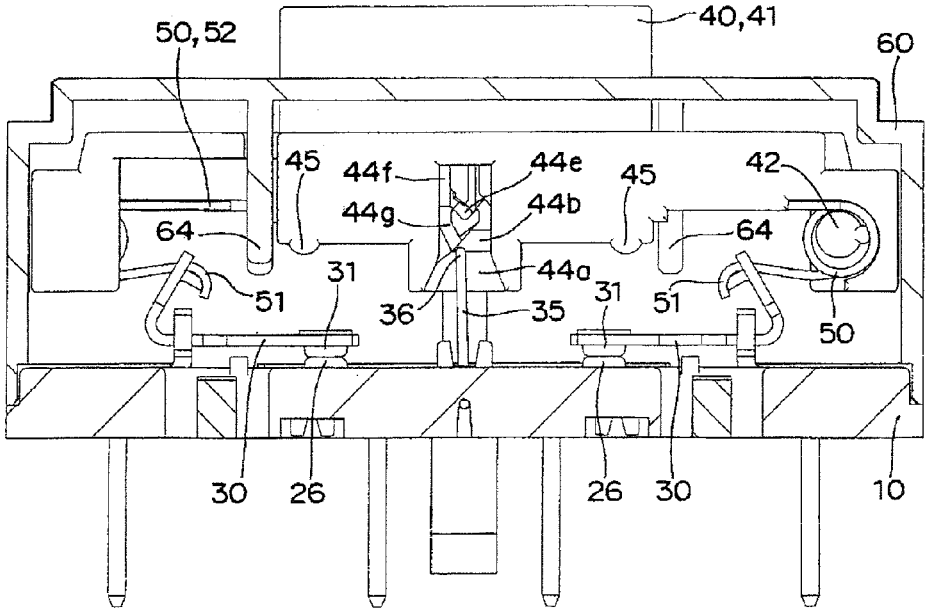
Figure 20A:
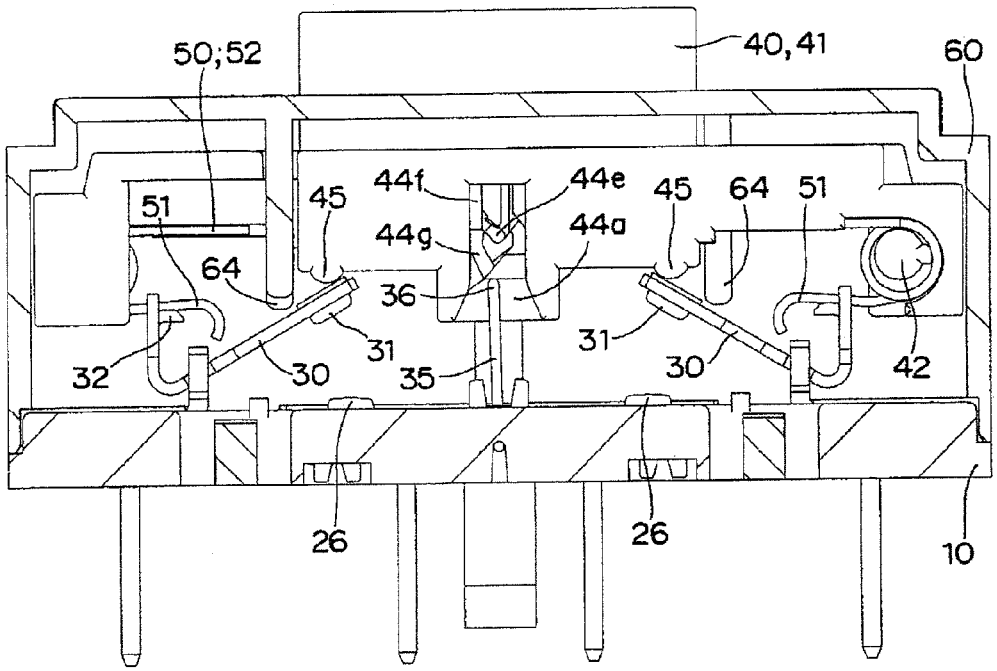
FIGS. 20A and 20B are enlarged sectional views showing the manipulation process continuous from FIG. 19.
Figure 20B:
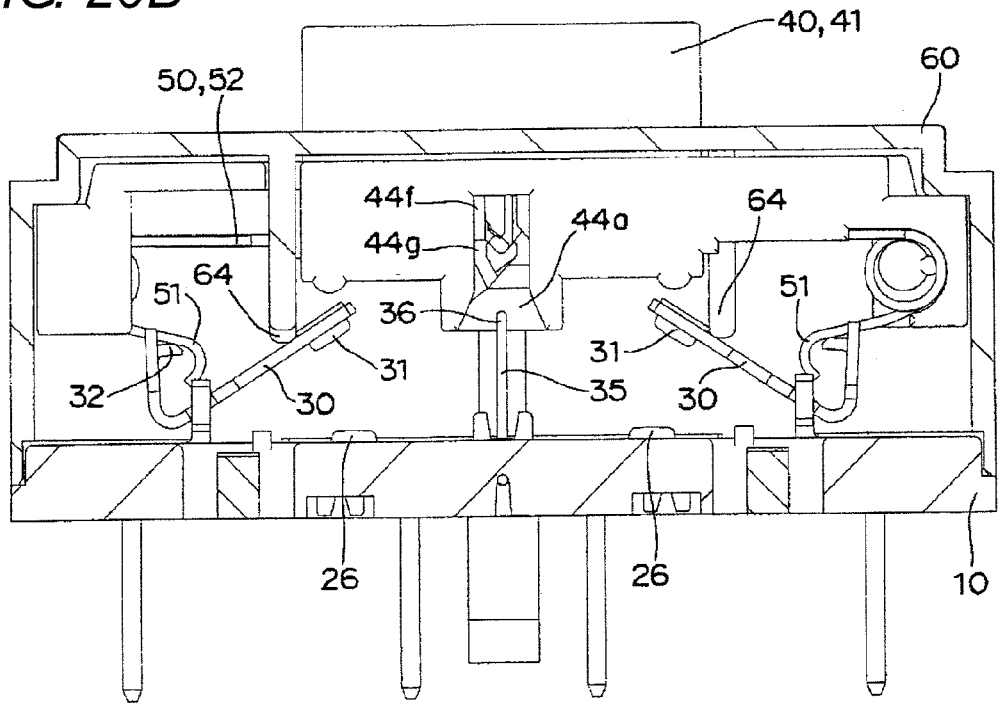

In releasing the locked state (FIG. 18), the manipulation portion 41 of the plunger 40 is pressed down deeper (FIG. 19A), and the upper end portion 36 of the lock pin 35 is moved from the locked position 44*e* to the fourth inclined groove 44*f*, thereby releasing the locked state. When the pressing force applied to the manipulation portion 41 is released, the coil spring 50 pushes up the plunger 40 while biasing the moving contact piece 30 in the direction in which the moving contact piece 30 is pushed down (FIG. 19B). Therefore, the upper end portion 36 of the lock pin 35 passes through the fifth inclined groove 44*g* to return to the first inclined groove 44*b*. When the plunger 40 returns automatically to the original position, one end portion 51 of the coil spring 50 biases the moving contact piece 30 in the direction in which the moving contact piece 30 is raised from the predetermined position, and the moving contact piece 30 turns instantaneously while the turning bracket 24 is used as the supporting point, thereby separating the moving contact 31 from the fixed contact 26 (FIG. 20A). After the moving contact piece 30 further turns, one end portion of the moving contact piece 30 abuts on the pressing projection 45 of the plunger 40. Then one end portion of the moving contact piece 30 abuts on the stopper 64 provided in the inner side face of the housing 60, and the position of the moving contact piece 30 is controlled. The upper end portion 36 of the lock pin 35 returns to the initial region 44*a* (FIG. 20B).

Figure 21A:
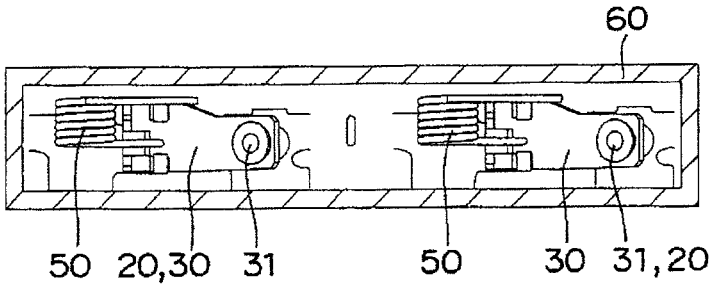
FIGS. 21A, 21B, and 21C are a transverse sectional view and longitudinal sectional views showing a switch according to a third embodiment of the invention.
Figure 21B:
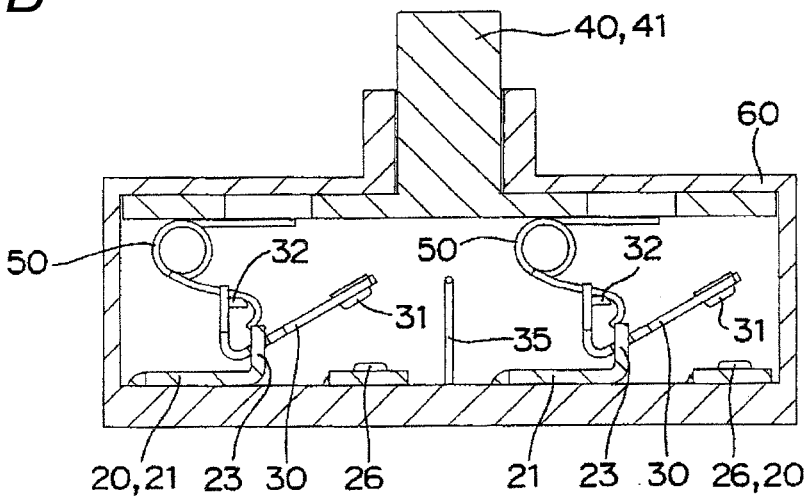
Figure 21C:
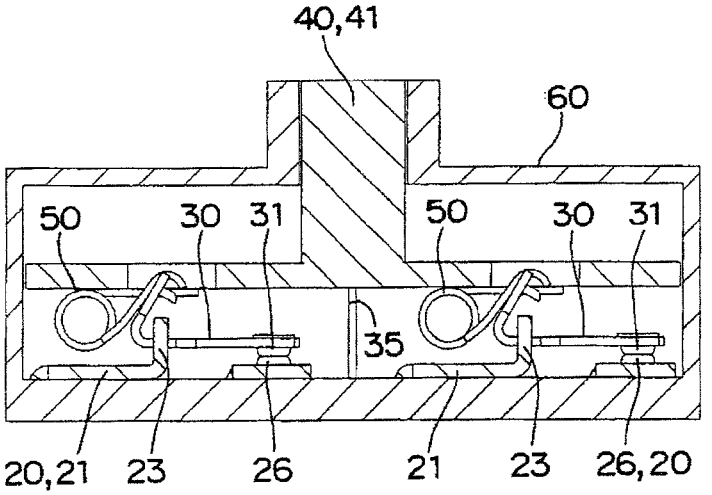

As shown in the schematic diagram of FIG. 21, a basic structure of a switch according to a third embodiment of the invention is substantially similar to that of the first embodiment except that the moving contacts 31 and 31 of the moving contact pieces 30 and 30 are disposed on one side in the same direction as the turning bracket (not illustrated) of the uprise piece 23 that becomes the supporting point of the turn.

Because other configurations of the second embodiment are similar to those of the first embodiment, the same component is designated by the same numeral, and the description is not given.

According to the third embodiment, advantageously the assembling property is improved because the coil springs 50 and 50 can be assembled in the plunger 40 from the same direction.

In the switch according to one or more embodiments of the invention, the pressing projection 45 of the plunger 40 may be provided if needed, and the pressing projection 45 may be removed if not needed.

One or more embodiments of the present invention may be applied to not only the alternate type switch in which the lock pin is necessary, but also the momentary type switch the lock pin is not necessary.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A switch comprising:

a base;

a housing;

a support terminal that is assembled in the base;

a pair of moving contact pieces, each of which is made of a band-shaped material having a section being formed into a substantial J-shape, a moving contact being provided in one end portion of the moving contact piece, an intermediate portion of the moving contact piece being turnably supported by a turning bracket of the support terminal;

a plunger that is accommodated in an internal space while being vertically movable, wherein the internal space is formed by fitting the housing in the base; and a coil spring that is turnably supported by the plunger, wherein the plunger is vertically moved such that one end portion of the coil spring is slid while brought into press-contact with an edge of the other end portion of the moving contact piece, whereby the moving contact piece is inverted to bring and separate the moving contact into contact with and from a fixed contact, the base has a longitudinal direction defined by a direction in which the base is longest, and comprises a central portion of the base defined as a center of the base in the longitudinal direction, and the pair of moving contact pieces is disposed on the base such that an entirety of a first moving contact piece of the pair of moving contact pieces is located on a first side of the central portion in the longitudinal direction of the base, and an entirety of a second moving contact piece of the pair of moving contact pieces is located on a second side of the central portion in the longitudinal direction of the base.

2. The switch according to claim 1, further comprising a lock pin having a lower end portion being turnably supported by the central portion in the longitudinal direction of the base, and an upper end portion of the lock pin abutting turnably on a cam groove in a center of a side face of the plunger, wherein the plunger is vertically moved to slide the upper end portion of the lock pin along the cam groove.

3. The switch according to claim 1, wherein the moving contacts of the pair of moving contact pieces are disposed outside the turning bracket provided in the pair of support terminals.

4. The switch according to claim 1, wherein the moving contacts of the pair of moving contact pieces are disposed inside the turning bracket provided in the pair of support terminals.

5. The switch according to claim 1, wherein the moving contacts of the pair of moving contact pieces are disposed on one side in an identical direction of the turning bracket provided in the pair of support terminals.

6. The switch according to claim 2, wherein the moving contacts of the pair of moving contact pieces are disposed outside the turning bracket provided in the pair of support terminals.

7. The switch according to claim 2, wherein the moving contacts of the pair of moving contact pieces are disposed inside the turning bracket provided in the pair of support terminals.

8. The switch according to claim 2, wherein the moving contacts of the pair of moving contact pieces are disposed on one side in an identical direction of the turning bracket provided in the pair of support terminals.

9. The switch according to claim 1, wherein a position of an uprise piece in which the turning bracket of the support terminal is provided is controlled by a position controlling projection provided in an upper-surface edge portion of the base.

10. The switch according to claim 2, wherein a position of an uprise piece in which the turning bracket of the support terminal is provided is controlled by a position controlling projection provided in an upper-surface edge portion of the base.

11. The switch according to claim 3, wherein a position of an uprise piece in which the turning bracket of the support terminal is provided is controlled by a position controlling projection provided in an upper-surface edge portion of the base.

12. The switch according to claim 4, wherein a position of an uprise piece in which the turning bracket of the support terminal is provided is controlled by a position controlling projection provided in an upper-surface edge portion of the base.

13. The switch according to claim 5, wherein a position of an uprise piece in which the turning bracket of the support terminal is provided is controlled by a position controlling projection provided in an upper-surface edge portion of the base.

14. The switch according to claim 6, wherein a position of an uprise piece in which the turning bracket of the support terminal is provided is controlled by a position controlling projection provided in an upper-surface edge portion of the base.

15. The switch according to claim 7, wherein a position of an uprise piece in which the turning bracket of the support terminal is provided is controlled by a position controlling projection provided in an upper-surface edge portion of the base.

16. The switch according to claim 8, wherein a position of an uprise piece in which the turning bracket of the support terminal is provided is controlled by a position controlling projection provided in an upper-surface edge portion of the base.

17. The switch according to claim 8, wherein the first and second contact pieces are disposed on a line in the longitudinal direction of the base.

* * * * *